US007322820B2

(12) United States Patent
Welton et al.

(10) Patent No.: US 7,322,820 B2
(45) Date of Patent: Jan. 29, 2008

(54) CONTROLLED FLAME GAS BURNER

(75) Inventors: Jeffrey A. Welton, Irvine, CA (US); Ralph E. Jennings, New Bern, NC (US); Hans Daerendinger, La Mirada, CA (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 0 days.

(21) Appl. No.: 10/008,727

(22) Filed: Nov. 8, 2001

(65) Prior Publication Data

US 2003/0087214 A1 May 8, 2003

(51) Int. Cl.

| | |
|---|---|
| ***F23D 14/06*** | (2006.01) |
| ***F23D 14/00*** | (2006.01) |
| ***F23D 14/58*** | (2006.01) |
| ***F23D 14/46*** | (2006.01) |

(52) U.S. Cl. ..... 431/354; 126/39 E; 431/350; 431/266

(58) Field of Classification Search ..... 431/354, 431/286, 349, 266, 350; 285/330, 394, 401; 239/548, 552, 556–558; 126/39 E
See application file for complete search history.

(56) References Cited

U.S. PATENT DOCUMENTS

| | | | | |
|---|---|---|---|---|
| 1,196,230 | A * | 8/1916 | Graves | 126/39 R |
| 1,720,909 | A * | 7/1929 | Lang | 126/214 R |
| 1,967,036 | A * | 7/1934 | Lithgow | 239/552 |
| 2,262,683 | A * | 11/1941 | Kauffman et al. | 239/544 |
| 2,320,754 | A * | 6/1943 | Sherman | 126/39 K |
| 3,597,135 | A * | 8/1971 | Kweller et al. | 431/148 |
| 3,825,404 | A * | 7/1974 | De Gouville | 431/354 |
| 4,565,523 | A * | 1/1986 | Berkelder | 431/354 |
| 4,690,636 | A * | 9/1987 | Lemonnier de Gouville et al. | 431/354 |
| 4,891,006 | A * | 1/1990 | Le Monnier de Gouville et al. | 431/349 |
| 5,133,658 | A * | 7/1992 | Le Monnier De Gouville et al. | 431/349 |
| 5,391,076 | A * | 2/1995 | Home | 431/354 |
| 5,397,234 | A * | 3/1995 | Kwiatek | 431/264 |
| 5,468,145 | A * | 11/1995 | Ferlin | 431/266 |
| 5,649,822 | A * | 7/1997 | Gertler et al. | 431/354 |
| 5,924,860 | A * | 7/1999 | Massey et al. | 431/266 |
| D414,377 | S * | 9/1999 | Huang | D7/407 |
| 6,030,207 | A * | 2/2000 | Saleri | 431/354 |
| 6,082,994 | A * | 7/2000 | Grandveau et al. | 431/349 |
| 6,146,132 | A * | 11/2000 | Harneit | 431/354 |

(Continued)

FOREIGN PATENT DOCUMENTS

| | | | |
|---|---|---|---|
| EP | 001099904 | A1 * | 5/2001 |

(Continued)

*Primary Examiner*—Carl D. Price
(74) *Attorney, Agent, or Firm*—Russell W. Warnock; James E. Howard

(57) ABSTRACT

A multiple fingered burner includes controls for continuity of gas flow and ignition throughout all of the ports peripherally positioned around the contoured wall of the burner body. A plurality of burner parts are nested together with an indexer limiting insertion to at least one predetermined alignment in order to avoid improper fit or alignment between adjacent burner parts. In addition, the peripherally positioned ports are covered by a laterally extending lip of a cap, and at least one of the parts includes recesses adjacent the laterally extending lip to provide ignitable gas flow passages along the peripheral wall of the burner that maintain continuity of ignition at adjacent burner ports.

11 Claims, 4 Drawing Sheets

U.S. PATENT DOCUMENTS

| | | | | |
|---|---|---|---|---|
| 6,263,868 | B1 * | 7/2001 | Koch et al. | 126/39 R |
| 6,299,436 | B1 * | 10/2001 | Huang | 431/354 |
| 6,318,993 | B1 * | 11/2001 | Huang | 431/354 |
| 6,371,754 | B1 * | 4/2002 | Haynes | 431/286 |
| 6,439,882 | B2 * | 8/2002 | Haynes et al. | 431/354 |
| 6,655,954 | B2 * | 12/2003 | Dane | 431/354 |
| 6,851,420 | B2 * | 2/2005 | Jennings | 126/39 R |

FOREIGN PATENT DOCUMENTS

| | | | |
|---|---|---|---|
| FR | 2136963 | * | 12/1972 |
| FR | 2 701 542 | * | 8/1994 |
| GB | 2 240 168 | * | 7/1991 |
| JP | 54-145030 | * | 11/1979 |
| JP | 55-102808 | * | 8/1980 |
| JP | 59-52113 | * | 3/1984 |
| JP | 60-11010 | * | 7/1985 |
| JP | 60-245929 | * | 12/1985 |
| JP | 11-264516 | * | 9/1999 |
| JP | 2000-55371 | * | 2/2000 |
| WO | WO 98/30838 | * | 7/1998 |
| WO | WO 00/13562 | * | 3/2000 |

* cited by examiner

CONTROLLED FLAME GAS BURNER

THE FIELD OF THE INVENTION

A gas burner for a cooking top includes a burner body with a plurality of fingers, a plurality of peripheral ports along each of the fingers and controls for gas flow along and through the fingers.

BACKGROUND ART

Although burners for controlling gas flow and flame generation in a cooking appliance have been known, a recent development that improves a flame spreading features within a controlled area so that the burner does not create a limited set of rings of heat application to a cooking utensil. For example, U.S. application Ser. No. 08/955,002, now U.S. Pat. No. 6,299,436, discloses a multiple fingered burner that expands the heating zone without exposing the peripheral ports in the fingers to exposure from spills occurring above the cooking top. Nevertheless, while such an arrangement improves distribution of the flames within a cooking top area, such irregularly shaped burners often have difficulty, particularly when sealed to the cooking top and subjected to various flow rates of primary air, in maintaining appropriately sized flame kernels throughout the irregular pattern of kernels throughout the cooking top area.

Moreover, while the known multiple fingered burner for cooking tops includes a burner body made of multiple pieces, proper operation and fit between the pieces was made a function of the shaping of the pieces with interfitting portions aligned along predetermined matching points of the shape. As a result, unless the interfitting portions of the shapes were accurately aligned by a user attempting to assemble a disassembled burner, for example, after cleaning the burner pieces, the user would have to use care in manipulating the pieces to physically align and fit the adjacent burner parts together, match the parts and properly connect the gas control paths. Slight misalignments may not be readily visible when parts have been prevented by some obstruction from nesting in a position that properly shapes the gas flow channels. Such misalignments could adversely affect proper operation of the burner and interfere with generation and distribution of flame kernels, the formation of the kernels and the control of ignition of the proper flame.

DISCLOSURE OF INVENTION

The present invention overcomes the above mentioned disadvantages by providing a multiple piece burner with multiple fingers that includes location controlling structural features that supplement the flow of gas for flame generation and distribution about the periphery of the burner. One novel feature employed is the use of recesses in the burner body, preferably in the burner cap lip that extend above peripheral gas ports, whereby flame continuity can exist around the entire periphery of the burner despite its convoluted or contoured shape for distribution of flame kernels throughout the cooking top area. An additional feature serving to improve control of the gas flow through the burner involves at least one indexer that properly aligns the plurality of the burner parts with respect to each other without masking any minor misalignments which can affect the ability of the burner pieces to precisely control the gas flow. As a result, the present invention improves the simplicity of using and cleaning cooktops and improves a user's ability to properly operate a reassembled burner body.

In a preferred embodiment, the burner body comprises a burner head having a plurality of ports or port forming openings along a peripheral wall of each of the plurality of fingers. The burner head is covered by a cap having a corresponding number of overlapping fingers extending laterally beyond the peripheral wall in the burner head. A plurality of flame guides connecting adjacent ports are formed in the extending portion of the cap, or in the peripheral wall, so that adjacent flame kernels may be connected by an ignitable path of gas flow. This structure assures continuity of the flame at all peripheral ports regardless of their location, alignment or distance from the burner's central source of gas supply to the ports.

In a preferred embodiment of the second novel feature, the burner body comprises a base for mounting the burner in the cooktop, preferably in sealed relation to the cooktop surface and at least one upper member defining, at least in part, a plurality of ports in a peripheral wall. Preferably, a collar carried by the base telescopically receives a stem carried by the at least one upper member with a sliding spline connection to form an indexer. Of course, the indexer may be carried by at least one of the collar and the stem, and limits insertion of the stem to a predetermined obtained between the at least one upper member and the base. As a result, the second feature aligns the upper member in a predetermined alignment with the base to assure that gas flow passages defined by surfaces of the parts are properly aligned for proper control of gas distribution throughout the periphery of the fingered burner when the burner parts appear to be in place. Any misalignment is readily, visibly indicated. A second indexer portion may also align additional portions of a burner, such as a burner cap, in relation to other parts of burner body, such as a burner head as shown in the preferred embodiment.

As a result, the present invention controls gas flow channels between displaceable burner parts by providing an indexing and nesting of the displaceable parts and assuring proper alignment in the nesting positions. In addition, the interaction of adjacent structures coupling the burner ports allows continuous flame generation between the ports so that continuity of flame around the irregular distribution of peripheral flame ports around the burner body is not affected by the distance from the gas supply or shaping of the body parts between the burner port inlets.

BRIEF DESCRIPTION OF DRAWING

The present invention will be better understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT

Figure 1:
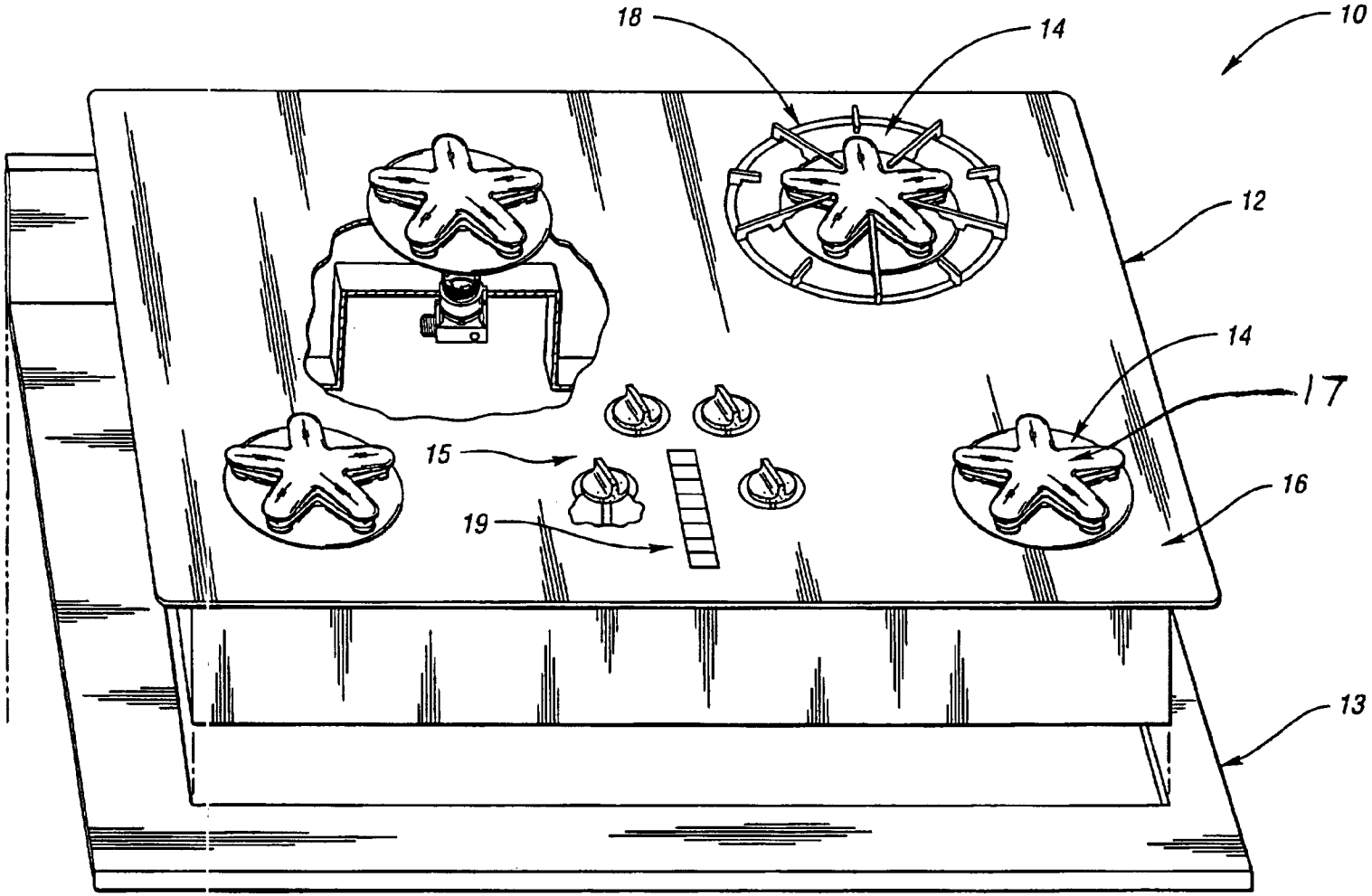
FIG. 1 is a perspective view of a cooktop appliance using burners constructed in accordance with the present invention.

Referring first to FIG. 1, a cooktop appliance 10 is shown comprising a cooktop 12 fitting within a counter top 13. Nevertheless, it is to be understood that the appliance 10 may comprise a cooktop 12 adapted to be supported in a dedicated, fabricated housing or in a combined cooking appliance housing such as an oven, range, grill or other combination cooking appliance. In any event, the cooktop 12 includes a plurality of burners 14, although the location number and style of burners may be varied on the cooktop 12 without departing from the present invention. Nevertheless, at least one of the burners 14 includes a burner body 17 formed of a plurality of parts and the parts are interfitted so as to nest in a position that controls gas flow through and around the burner as will be described in greater detail below.

In addition, the cooktop 12 includes a plurality of controls 15 and indica 19 for operating the ignition and control of the gas supplied to each burner 14. Preferably, the control includes a microprocessor-based control, and preferably including a pulsed sequence burner operation in which flame may be ignited around the burner in a pulsed sequence so that areas of a cooking utensil are not continuously singed by exposure to open flame throughout a cooking period. Nevertheless, the types of controls may be changed without departing from the scope of the present invention as will be discussed in greater detail below.

Each burner 14 may include a body 17 and, in the preferred embodiment, a grate 18 that provides a utensil support surface above the burner body 17. In the preferred embodiment, the burner body 17 is mounted in a fixed position with respect to the cooktop surface 16, and preferably a sealed burner installation that does not permit leakage of fluids, i.e. gas or liquid, between the cooktop surface 16 and the interior of counter top 13. The body may include means for self-aligning the grate 18 with respect to the burner 14 mounted in the fixed position on the burner surface 16. Nevertheless, it is to be understood that other means for supporting the grate 18 or the burner body 17 may also be used, for example, a cavity formed in the surface 16 that is dimensioned to receive the peripheral rim of the grate 18, or to receive a bottom of the body 17, without departing from the scope of this present invention.

Figure 2:
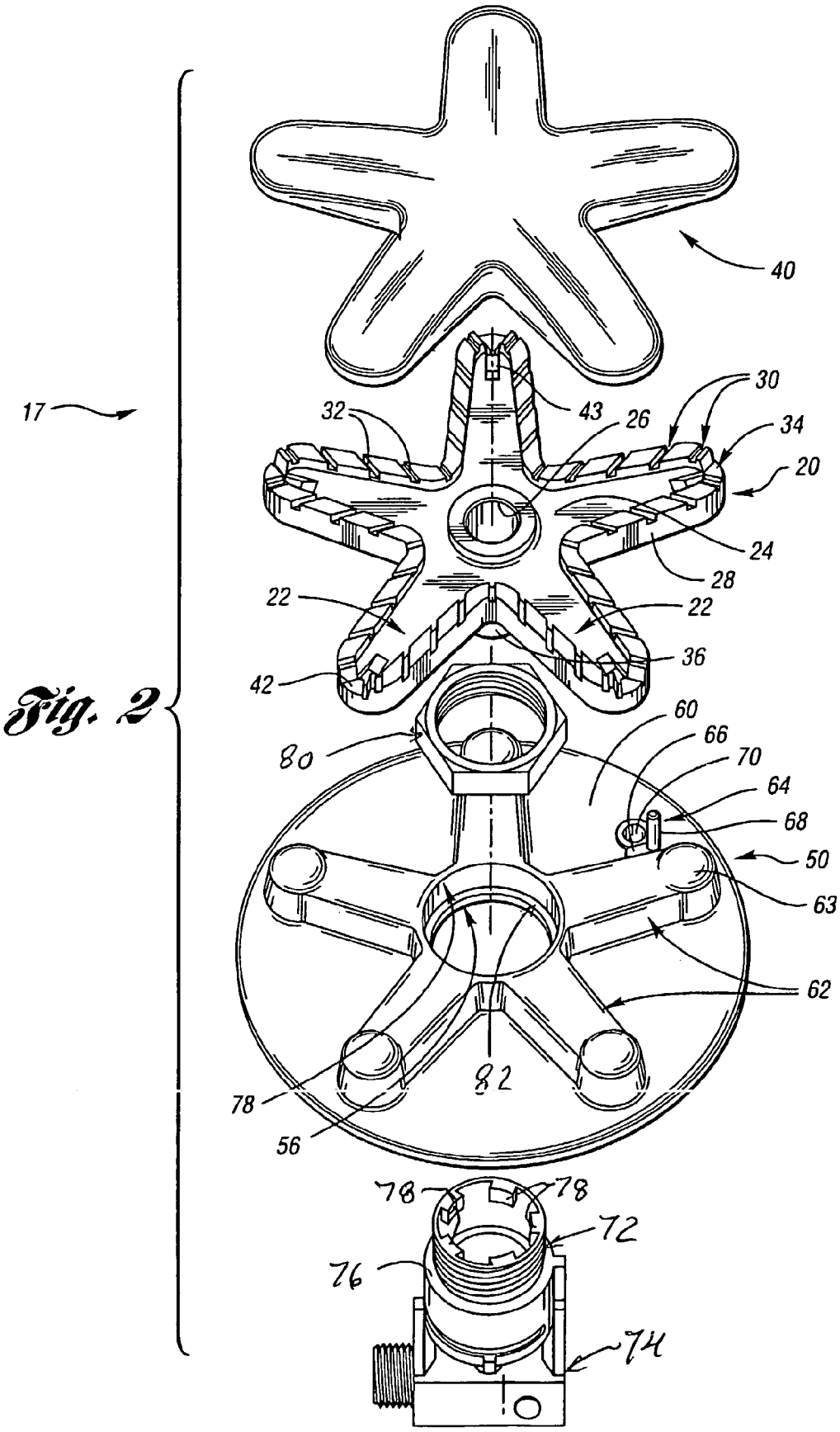
FIG. 2 is an enlarged, exploded perspective view of a burner construction shown in FIG. 1.
Figure 3:
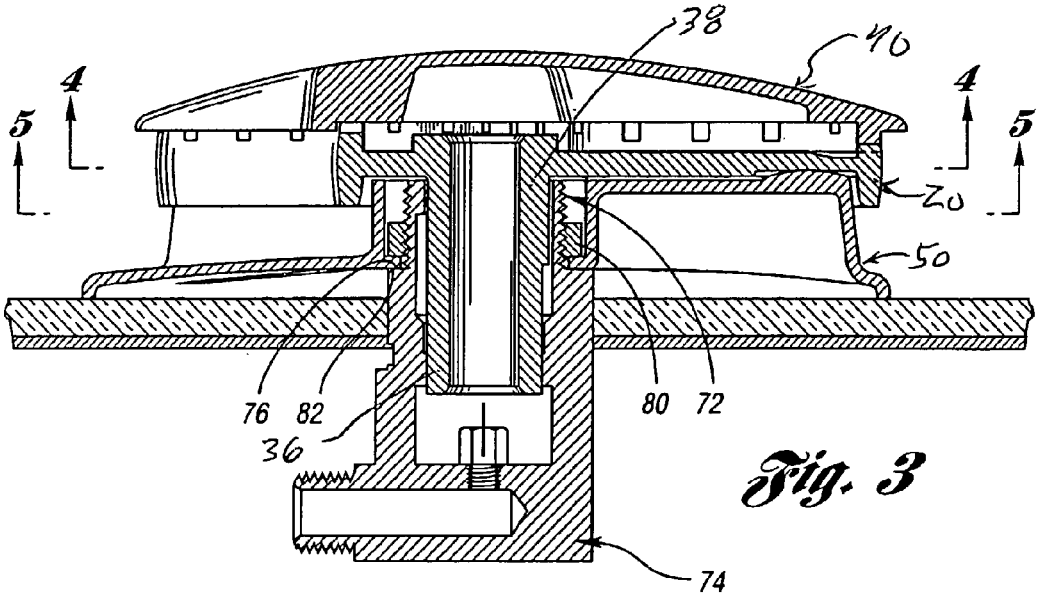
FIG. 3 is a sectional view taken substantially along the line 3-3 in FIG. 1.
Figure 5:
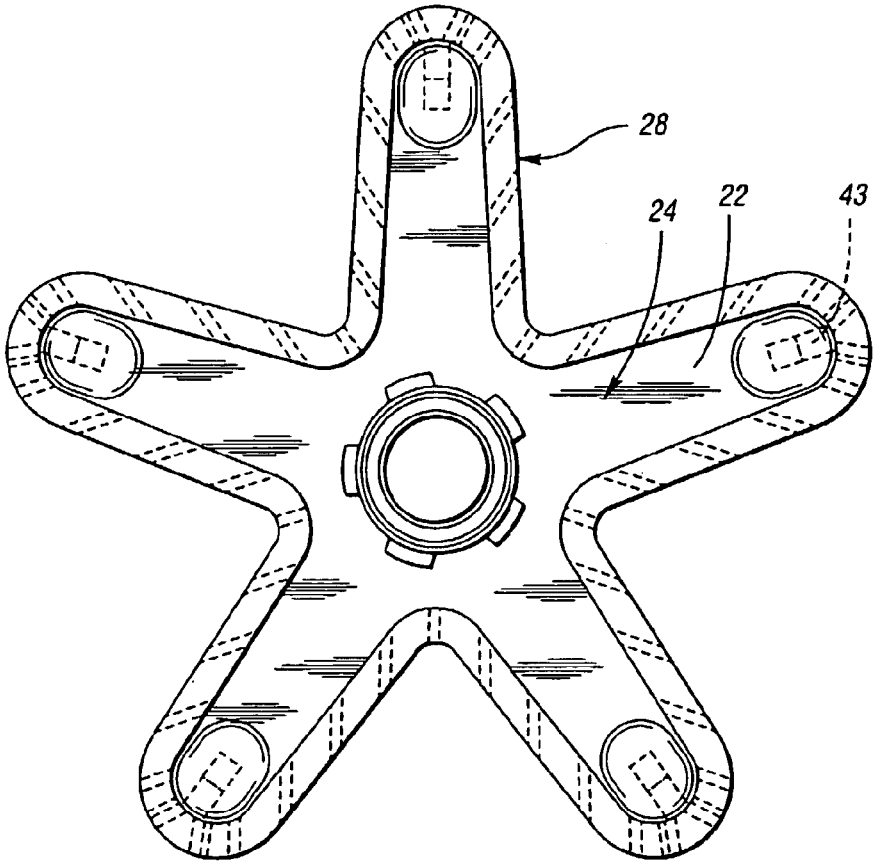
FIG. 5 is a view taken substantially along line 5-5 in FIG. 3.

Referring now to FIG. 2, the body 17 as constructed in the preferred embodiment includes a burner head 20, a burner cap 40 and a burner base 50. Referring first to the head 20, the head includes central wall 24 that defines a plurality of fingers 22 extending outwardly from a center aperture 26 in a central wall 24 in the head 20. The central wall 24 supports a peripheral wall 28 including a plurality of openings 30 for forming ports in the body 17. In the preferred embodiment, the openings are in the form of slots 32 aligned in predetermined positions with respect to the fingers 22 of the body 17 as will be described in greater detail below. The central opening 26 is defined by a stem 36 including a plurality of external splines 38 (FIGS. 3 and 5). Preferably, the splines 38 terminate at a flat wall that may be tapered or otherwise radiused to abuttingly engage like surfaces on a correspondingly splined part, either in the base 50 or in parts carried by the base 50, to form an indexer between the head 20 and the base 50, as will be described at greater detail below.

The peripheral wall 28 also includes terminal recesses 34 at the ends of each finger 22. Each recess 34 in the wall 28 includes a footing 42 intermediate two grooves 32. The grooves 32 on opposite sides of the footing 42 communicate with a recess 43 formed in the base wall 24 at the end of the finger 22.

In the preferred embodiment, the base 50 includes a central wall 60 having a raised support wall 62 that corresponds with the shape and positions of the fingers 22 formed in the burner head 20. The ends of each support wall finger 62 include raised footings 63 that support portions of the central wall 24 of the head 20 above the tops of the fingered support wall 62 and the central wall 60 of the base 50 to permit the flow of secondary air that aids combustion. In addition, the base 50 supports a mounting 64 for an igniter. In order to accommodate various materials employed in the construction of the burner parts, and the coatings that may be applied to the parts of the burner body, a mounting of the preferred embodiment of the invention includes a support 66 for a grounding stem 68 positioned adjacent a mounting opening 70 for an igniter plug. In addition, an opening 56 is formed in the center of the base plate 50.

The opening 56 receives a threaded sleeve 72 of a jet holder 74. The externally threaded sleeve 72 also includes internal elements, cooperating with the indexer—forming parts, for example, splines 38 of the burner head stem 36, to form the indexer. Preferably, the threaded sleeve 72 extends outwardly from an annular shoulder 76 of the jet holder, while the base 50 includes an expanded hole portion 78 that enables a threaded ring 80 to be threadedly engaged with the externally threaded sleeve 72 when the sleeve 72 has been inserted through the base 50 so as to lock a portion of the base plate, such as shoulder 82, between the threaded ring 80 and the annular shoulder 76. The base is then mounted to the cooktop.

Figure 6A:
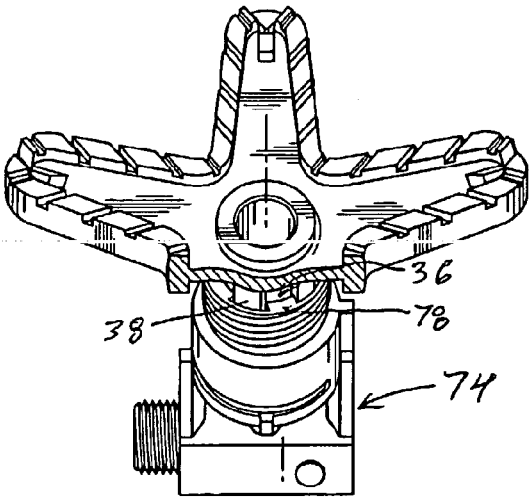
FIG. 6 is a view similar to FIG. 3, but showing another position of parts shown in FIGS. 1-5.
Figure 6B:
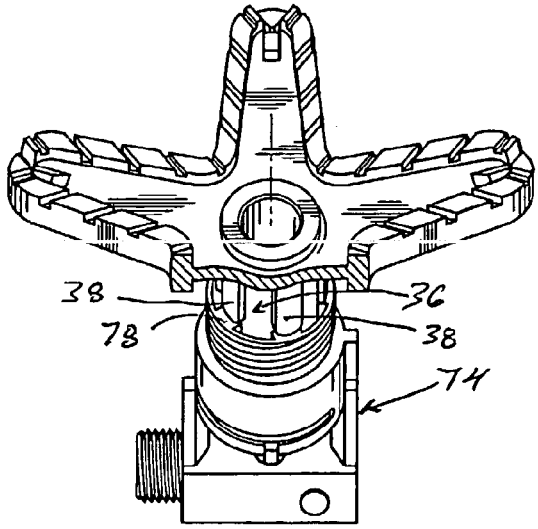

In the preferred embodiment, the ends of the splines 38 on the stem 36 abut against the tops of the splines 78 formed in the interior of the jet holder 74 when the splines are not aligned with recesses in the indexer. As a result, the head 20 remains in a spaced position, as shown in FIG. 6, above the base 50 and the fingers of support walls 62 unless and until the stem 36 is rotated so that the splines 38 align with recesses adjacent to splines 78 in the sleeve 72 as shown in solid lines in FIG. 5. The predetermined alignment position may be a single position or, as in the preferred embodiment, the fingers of the head 20 may be disposed over any of the support walls 62 at numerous rotary positions.

As shown in FIGS. 2 and 3, the spaced slots 32 formed in the burner head 20 may have various cross sectional shapes, depths, widths, and orientations with respect to each other and the direction of the finger. In the preferred embodiment, the slots 32 are shown aligned with a plane intersecting the center of the head 20 from a point between the axes of adjacent fingers 22 and are preferably aligned as parallel with respect to each other along adjacent edges of the finger on opposite sides of the point. At the terminal ends of each finger 22, the footing 42 separates diverging ports 32 that communicate with the recess 43 in the central wall 24 adjacent the footing 42. The footing 42 receives a leg 84 formed on the cap 40. The arrangement of legs 84 and recessed footings 42 form a second indexer that limits installation to a correct alignment at which the parts cannot appear to be in proper position.

The cap 20 includes a plurality of tapered fingers 22 whose highest portion is at the center of the cap 20. In particular, a recess 86, corresponding with the area enclosed within the peripheral wall 28 of each finger 22, is formed in the cap 40. An intermediate wall portion between the recess 86 and the lateral extending lip 88 on the cap 40 is substantially flat over the top of the peripheral wall 28.

Figure 4:
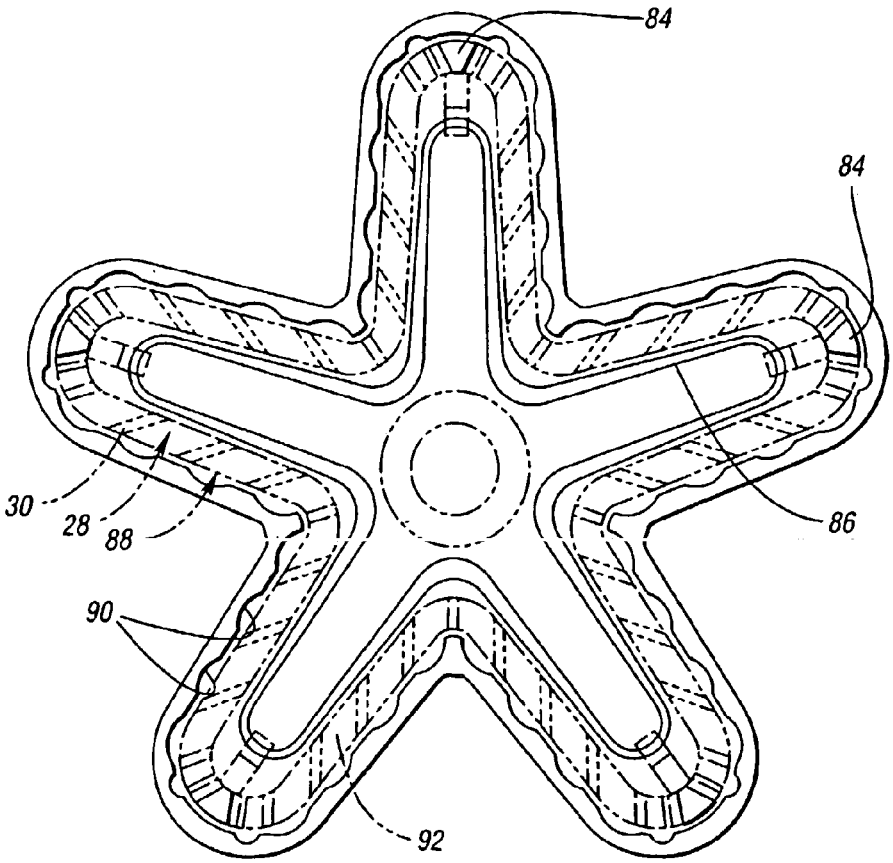
FIG. 4 is a view taken substantially along the direction of the arrows 4-4 in FIG. 3.

As best shown in FIG. 4, the laterally extending lip 88 includes a plurality of recesses 90 that contribute to the flow of gas between adjacent port openings 30 to improve the continuity of flame around the irregular periphery of the burner. In the preferred embodiment, the deepest or widest portions of the recesses lie adjacent to the peripheral wall portions 92 between ports to allow a large enough flow path between burner port outlets 30 to be maintained under the lip 88.

As a result, it will be understood that the burner of the present invention provides a wide distribution of flame at a burner location while ensuring continuity of the flame ignited around the irregular periphery, and maintaining a strict control of the gas flow. Similarly, control of the gas flow is aided by the intermitting parts of the burner that nest together in a predetermined position in order to maintain precise positioning of the flow path and accurate locating of the ignitor with respect to the ignitable port outlets of openings 30.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A burner with a plurality of fingers, comprising:

a burner head;

a base supporting said plurality of base fingers around an opening through which gas flows from a fuel source to said burner head, each of said base fingers extending outwardly relative to said opening with each said base finger having an interior that is not in communication with said opening such that, when said base is mounted in a fixed position with respect to a cooktop surface of a counter top, fluid leakage between an interior of the cooktop and the surroundings of the cooktop via one of said base fingers is substantially foreclosed;

said burner head having burner head fingers corresponding in number to said plurality of base fingers of said base and having a peripheral wall with a second plurality of ports positioned along both sides of the peripheral wall of each one of said plurality of burner head fingers, said burner head being in communication with said opening of said base for the flow of gas from a fuel source to said burner head;

said second plurality of ports formed continuously and substantially evenly spaced around each of said burner head fingers formed in said burner head and each of said ports formed as a slot in an upper portion of said peripheral wall of said burner head;

a cap having a plurality of overlapping fingers corresponding in number to said plurality of burner head fingers and having a lip extending laterally beyond peripheral wall of said burner head; and a plurality of flame vents connecting adjacent ports along said peripheral wall of said burner head.

2. The invention as defined in claim 1 wherein each vent includes a recess, formed in said cap, positioned intermediate adjacent ports.

3. The invention as defined in claim 2 wherein said recess includes an expanded transfer area at an intermediate point between said adjacent ports.

4. The invention as defined in claim 2 wherein said recess is formed in said cap and bounded by a protruding lip.

5. The invention as defined in claim 4 wherein said lip comprises a continuous wall along each said finger.

6. The invention as defined in claim 5 wherein said lip is scalloped laterally around said wall on an interior side thereof.

7. The invention as defined in claim 1 wherein each of said base fingers is configured as a raised elongated finger formation and said base is a generally planer structure having a top surface and bottom surface, the base includes a central opening defining a passage between the top and bottom surfaces and wherein the central opening of the base is sealed to and in fluid communication with a fuel gas mixture supply passage, wherein the raised elongated finger formations extend upward from the top surface of the base, wherein each of the raised elongated finger formations define an interior open space defining an elongated opening along the length of each of the elongated finger formations on the bottom surface of the generally planar base, and wherein each of the elongated finger formations extend in a direction radially outward from the central opening and the interior open space and elongated opening do not communicate with the passage defined by the central opening of the base, whereby when the base is mounted on a cooking surface of a cooktop and the central opening of the base is aligned with a cooking surface opening through which the fuel gas mixture supply passage extends from an interior space location within the cooktop and located below the cooking surface, generally planar structure sized to extend radially outward of the cooking surface opening, whereby fluid leakage through the cooking surface opening and the interior space of the cooktop is substantially foreclosed by said base.

8. A burner for a cooktop comprising:

at least one upper member;

a base for mounting said burner in a cooktop, said base supporting a plurality of fingers around an opening defined therein through which gas flows to a burner head for ignition and burning thereof, each of said fingers extending outwardly relative to said opening and having an interior that is not in communication with said opening such that, when said base is mounted in a fixed position with respect to a cooktop surface of the counter top, fluid leakage between an interior of the cooktop and the surrounding of the cooktop via one of said base fingers is substantially foreclosed;

said at least one upper member defining at least in part a plurality of ports on each side of a plurality of fingers;

said plurality of ports formed continuously and substantially evenly spaced around each of said fingers and each of said ports formed as a slot in an upper portion of said upper member;

a first plurality of splines projecting from said base adjacent said opening therein;

a second plurality of splines formed around the periphery of a stem carried by at least one upper member; and an indexer carried by at least one of said base and said stem limiting insertion of said stem to at least one predetermined alignment, said indexer aligning said at least one upper member in said at least one predetermined alignment with said base, said indexer including said first plurality of splines and a said second plurality of splines, said first plurality of splines and said second plurality of splines interlocking with one another in said at least one predetermined alignment.

9. The invention as defined in claim 8 wherein said base includes an igniter element and wherein said predetermined alignment positions said igniter element adjacent one of said ports.

10. The invention as defined in claim 8 wherein said at least one member includes a burner head having said plurality of fingers with a peripheral wall enclosing a gas path and including said plurality of port openings.

11. A cooktop burner comprising:

a body having a plurality of fingers extending outwardly from a central body portion, said body comprising:

a burner head having a central wall, and a peripheral wall on the central wall including a plurality of openings forming ports;

said plurality of openings forming ports formed continuously and substantially evenly spaced around said central wall and each of said ports formed as a slot only in an upper portion of said peripheral wall;

a base including a head support for said head, and a support for an igniter, said base supporting said plurality of fingers around an opening in said central body portion through which gas flows between the interior of a counter top and said burner head, each of said fingers extending outwardly relative to said opening and having an interior that is not in communication with said opening such that, when said base is mounted in a fixed position with respect to a cooktop surface of the counter top, fluid leakage between an interior of the cooktop and the surroundings of the cooktop via one of said base fingers is substantially foreclosed and said head support includes a first indexer including a plurality of splines for limiting insertion of said head to at least one predetermined alignment with respect to said igniter support; and a burner cap including a covering wall positioned over said peripheral wall, a support for carrying said head on said head support, said support including a second indexer for aligning said head at a predetermined alignment with respect to said head support.

* * * * *